United States Patent [19]

Maurer

[11] 3,999,399

[45] Dec. 28, 1976

[54] PROTECTIVE GUARD MEANS FOR WOOD PILING AND A METHOD OF INSTALLING SAME UNDER DRY WORKING CONDITIONS

[75] Inventor: John R. Maurer, Glendora, Calif.

[73] Assignee: Walter A. Plummer, Sherman Oaks, Calif.

[22] Filed: Nov. 8, 1974

[21] Appl. No.: 521,970

Related U.S. Application Data

[63] Continuation of Ser. No. 367,816, June 7, 1973, abandoned.

[52] U.S. Cl. ..... 61/54; 61/48; 24/197; 52/623

[51] Int. Cl.[2] ..... E02D 5/60

[58] Field of Search ..... 61/54; 52/728, 169, 52/170, 614, 623; 138/99, 97

[56] References Cited

UNITED STATES PATENTS

| | | | |
|---|---|---|---|
| 967,442 | 8/1910 | Rowe et al. | 52/728 X |
| 1,435,311 | 11/1922 | Knight | 138/110 |
| 3,103,103 | 9/1963 | Liddell | 61/54 |
| 3,181,300 | 5/1965 | Plummer | 61/54 X |
| 3,321,924 | 5/1967 | Liddell | 61/54 |
| 3,372,552 | 3/1968 | Liddell | 61/54 |
| 3,719,049 | 3/1973 | Shaw | 61/54 |
| 3,736,759 | 6/1973 | Blose | 61/54 |

FOREIGN PATENTS OR APPLICATIONS

| | | | |
|---|---|---|---|
| 98,795 | 12/1924 | Austria | 24/197 |
| 567,345 | 12/1923 | France | 24/197 |

*Primary Examiner*—Jacob Shapiro
*Attorney, Agent, or Firm*—Sellers and Brace

[57] ABSTRACT

Protective guard means for wood piling which includes a one-piece waterproof seamed plastic jacket for water-contacted portions of the piling from a level below the lowest water level to a point above high water level. The jacket is gathered snugly about and cinched to the piling and preferably includes a liner immune to attack by wood preservative chemicals. An arcuate guard strip of tough, high impact strength sheet resinous material is clamped to the exterior of the plastic jacket for that portion of the piling likely to be struck, buffeted or abraded by water craft and floating objects. The described protective guard means are assembled to the piling before the piling is driven and preferably above water level and under dry working conditions without need for divers or underwater equipment.

4 Claims, 7 Drawing Figures

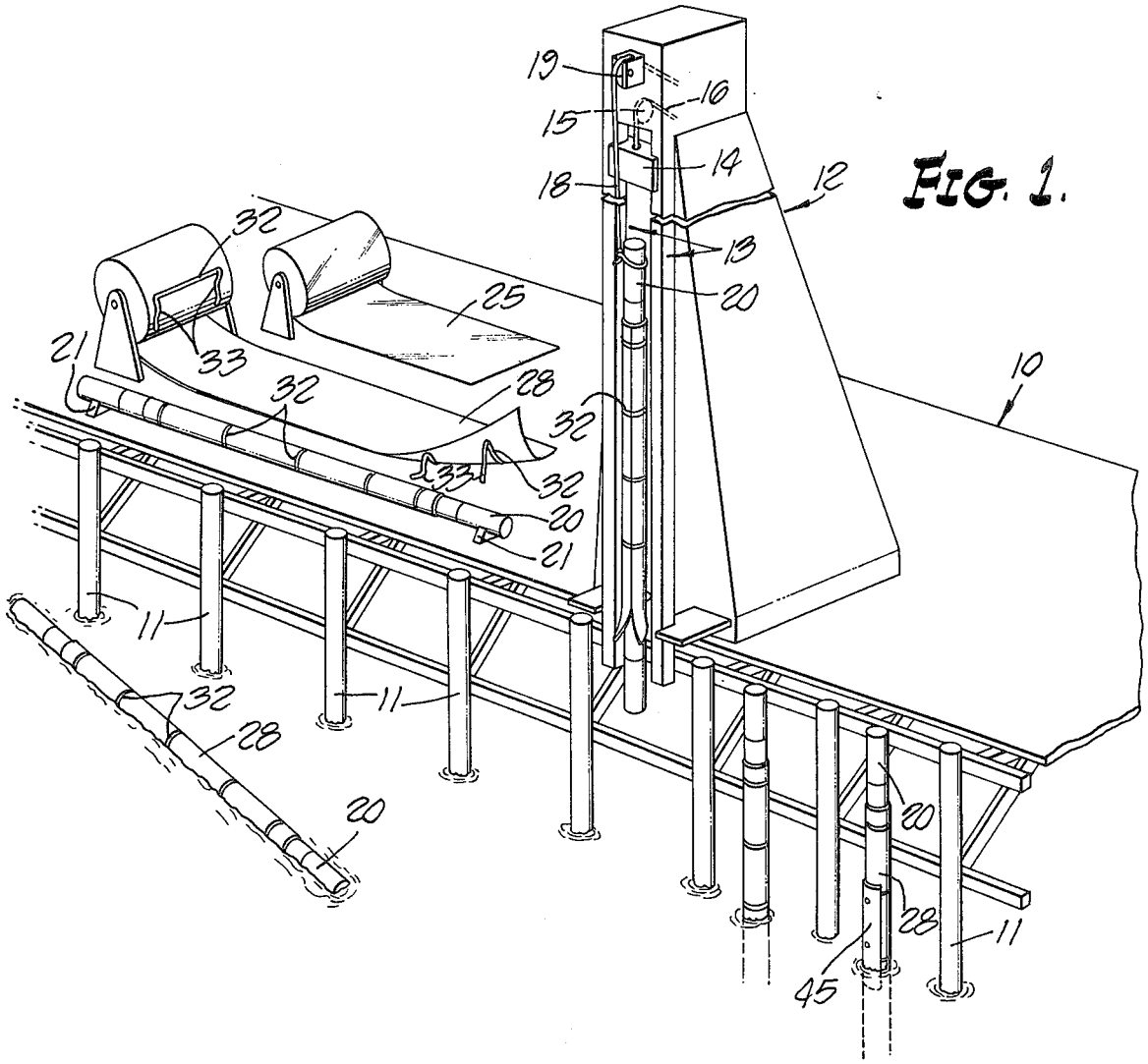
FIG. 1.
FIG. 5.
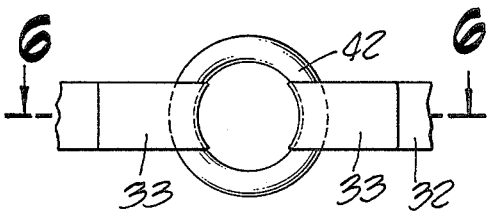
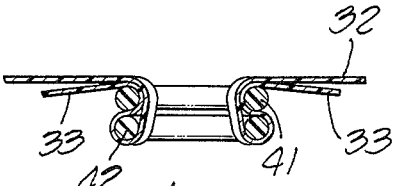
FIG. 6.
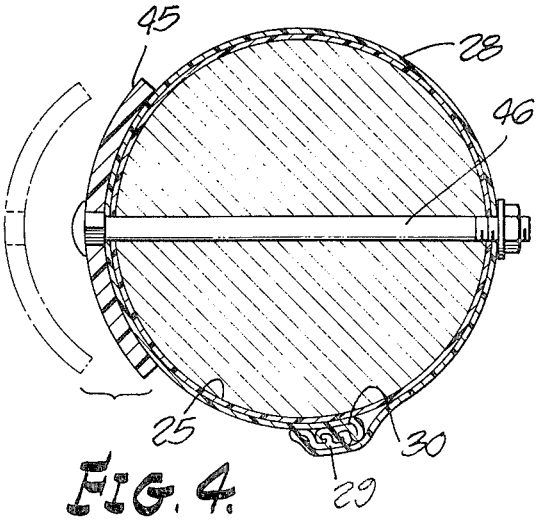
FIG. 4.

PROTECTIVE GUARD MEANS FOR WOOD PILING AND A METHOD OF INSTALLING SAME UNDER DRY WORKING CONDITIONS

This application is a continuation of my application for U.S. Letters Pat. Ser. No. 367,816, filed June 7, 1973, now abandoned, entitled "Protective Guard Means for Wood Piling and a Method of Installing Same Under Dry Working Conditions."

This invention relates to piling installed along the shoreline, and more particularly to the improved protective guard means and to a method of assembling the same to piling before driving the piling and under dry working conditions without need for diving equipment.

Wood piling has been used for many years to support piers, wharves, and for slips and the like and it is well known that such piling is subject to many hazards necessitating replacement of the piling. In order to avoid the problems, time and expense involved in replacing damaged piling, various proposals have been advanced for safeguarding against these numerous hazards. Among the serious hazards are those presented by marine life which attack the wood piling.

Various guard devices have been proposed for installation about the piling but these are subject to differing objections and disadvantages sought to be avoided by the present invention. One protective measure involves enclosing the portion of the piling in direct contact with water with plastic sheeting. This provides a barrier to access by marine life not already present on the piling and traps life already present along with the water inside the jacket. In consequence, the rapid depletion of oxygen present in the water deprives the marine life of this vital gas and arrests further damage to the piling. This protective measure has proven quite effective but is subject to certain serious disadvantages in that it involves the use of divers and diving equipment for assembly of the jacketing to the piling. Moreover, the jacketing has a loose fit with the piling with the result that wave action and typical water action along the shoreline causes continuous movement, buffeting and chafing of the jacketing and undesirable wear and premature failure thereof. Additionally, no satisfactory means has been provided for protecting the plastic jacketing against abrasion and impact by water craft and other floating objects.

According to this invention, the foregoing and other shortcomings of prior piling protective measures are obviated with corresponding economies in time, labor and improved assembly techniques. The protective plastic jacketing is prepared in continuous strips equipped at the factory with closely spaced tie bands. This enables the continuous jacketing to be cut to the full length required for each particular length of piling and to be assembled to the piling under convenient and unhampered dry working conditions and while the dry piling is supported horizontally or suspended above water level in pile driving equipment preparatory to installation in a water bed. Preferably a continuous length of plastic sheeting immune to attack by commonly employed wood preservatives is cut to length along with the main jacketing and installed and assembled along therewith as an inner layer inserted between the piling proper and the main plastic jacket. At least the upper and possibly the lower end of the jacket is sealed against a resilient sealing collar, the assembly seam is closed, and any excess material girthwise of the piling is gathered and overlapped as the tie bands are cinched tight to hold the jacketing gathered snugly about the piling.

Impact and abrasion damage to the jacketing is further safeguarded against by a thick guard strip of tough high impact resistant resinous material clamped against the exterior of the jacket along the face of the piling exposed to injury by watercraft and floating objects. This tough resistant guard member is preferably secured to the piling by fasteners in alignment with one another thereby leaving the remainder of the guard strip free to flex and absorb impact blows. Desirably this guard strip has an initial radius of curvature shorter than that of the underlying piling, rendering the guard readily adaptable to piling of a range of diameters.

Accordingly, it is a primary object of the present invention to provide improved protective means for piling and to a method of assembling the same to piling prior to being driven and without need for divers or diving equipment.

Another object of the invention is the provision of a one piece protective jacket for piling severed to length in the field from a continuous length of the jacket and readily snugly assembled about piling above water under dry working conditions.

Another object of the invention is the provision of an improved piling protector and means for assembling the same whether the piling is supported horizontally or suspended from its upper end in readiness for but before driving into a water bed.

Another object of the invention is the provision of continuous strip of plastic sheeting formed with interlocking seams along its lateral edges and equipped with permanently attached tie bands at intervals readily connected and tensioned under dry working conditions or by divers submerged in water.

Another object of the invention is the provision of a resilient high impact absorbing guard member securable to piling from a point above high water level to a point below water level and in an area exposed to impact and abrasion by watercraft and floating objects.

These and other more specific objects will appear upon reading the following specification and claims and upon considering in connection therewith the attached drawing to which they relate.

Referring now to the drawing in which a preferred embodiment of the invention is illustrated:

FIG. 1 is a perspective view showing mobile pile driving equipment supported on a wharf and suspending a length of piling with workmen assembling the invention protective jacket working in areas above water level, and also showing another length of piling supported on the wharf after assembly of protective jacketing and awaiting installation in water;

FIG. 4 is a cross-sectional view on an enlarged scale taken along line 4—4 on FIG. 2, the dot and dash line showing the normal relaxed contour of the protective strip before being clamped to the piling;

FIG. 5 is a fragmentary frontal view of the cinching means for the tie band;

FIG. 6 is a cross-sectional view taken along line 6—6 on FIG. 5; and

Figure 2:
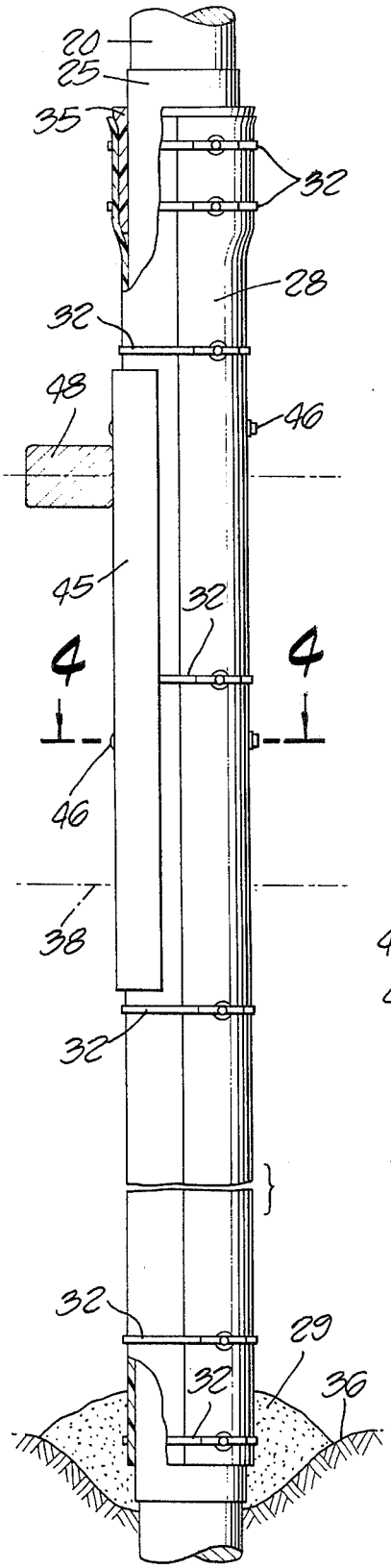
FIG. 2 is an elevational view of a driven pile equipped with the invention jacketing with portions broken away to show construction details.

Referring initially to FIG. 1, there is shown a typical operating environment with the invention piling protector in the process of assembly to piling under completely dry operating conditions, and in accordance with both horizontal and upright assembly procedures. There illustrated is a typical pier 10 supported by a multiplicity of wood piling 11,11 driven into the water bed in accordance with customary practice. Unserviceable ones of the piling are undergoing replacement by the aid of a mobile pile driver designated generally 12, movable from position to position along the top surface of pier 10. Although the pile driver is shown as supported on the pier, it will be understood that it may be supported on a raft or a barge movable from position to position along the side of the pier. Driver 12 includes a pair of parallel ways 13,13 along which the driver weight 14 falls to drive the piles, weight 14 being lifted to an elevated point by means of the pulley 15 and cable 16 following which the weight is allowed to fall freely onto the top of the pile to drive it. New piling to be driven is elevated to its driving position between ways 13 by means of a cable 18 and a pulley 19, it being understood that each cable is operated from a separate power winch.

Prior to being driven into the ground, piling 20 is enclosed with the invention protective jacketing under dry operating conditions while supported horizontally on the pier on chuck blocks 21,21. Alternatively, the wooden piling 20 may be suspended from the lower end of cable 18. In either case the piling is dry and the workmen may proceed with the jacketing assembly operation in open air.

Customarily, the wood piling 20 has been chemically treated with creosote or other preservative, particularly along the portion thereof subject to alternate exposure to air and water. Portions of the piling maintained continuously submerged in water are not subject to decay and deterioration and need not be chemically treated. Certain plastic materials such as polyvinyl chloride commonly employed for the main protective jacket are not immune to attack by creosote and chemical preservatives for the wood piling. Accordingly, those portions of the piling are enclosed in a protective plastic film, such as a 4 mil thick sheet of polyethylene. This material is supplied in a continuous length of strip material having a width in excess of that required to encircle the largest diameter portion of the piling. The required length of the liner material 25 is severed from the supply and wrapped about the portion of the piling requiring protection and suitably secured in place as by tacking, pressure sensitive tape or the like.

The next step is to sever the required length of the main jacket 28 from a continuous supply contained either in a coiled roll or folded accordian style and removable from either type of supply with the outer side of the jacket facing outwardly. Suitably bonded or heat sealed to either lateral edge of jacket material 28 is a continuous interlocking seam forming member 29,30 (FIG. 4) of extruded semi-rigid plastic material. These extruded plastic seam forming members are of a well known type having complementally shaped tongues and grooves which interlock with one another when pressed together to provide a fluid-tight seam.

Suitably secured crosswise of the outer side of jacket 28 at intervals therealong are a plurality of high strength tie bands 32 having free ends projecting beyond the opposite edges of the jacket proper. These tie bands may be suitably reinforced with fiberglass or other high strength fabric embedded in polyvinyl chloride plastic material and heat sealed or otherwise bonded to the main body of the jacket. A single jacket of sufficient length to enclose the full length of the piling requiring protection is severed from the supply of the jacketing material and then wrapped about the piling after a resilient plastic sealing collar 35 has been wrapped at least about the piling underlying the upper end of the protective jacket. In some cases it is essential that jacket 28 extend below the mudline of water bed 36 (FIG. 2). In some coastal regions, marine bore activity is active down to and even below the mudline whereas in other areas it is not; in the latter event, jacket 28 need not extend to the mudline but may terminate well below the low tide level indicated at 38 in FIG. 7 and below the level subject to attack in that locality. In this event, it is desirable to employ a second resilient sealing collar or gasket 35 (FIG. 7) to safeguard against "pumping action," i.e., the exchange of water within the jacket due to changes in tide level and the like external water conditions. In localities where the jacket desirably extends one or two feet below the mudline, a lower sealing collar is unnecessary and, instead, a mudfill 39 is usually placed about the base of the jacket after the piling has been driven to its fully installed position.

Jacket 28 is wrapped about piling 20 and the two seam members 29,30 are pressed closed for the full length of the jacket. Usually there is excess jacket material girthwise. In this case the excess material is gathered preferably by placing the tips of the fingers of the operator's hands against the closed seam with the excess jacket material being gathered toward the palms of the operator's hands and against the far side of the seam. This gathered material is then folded along with the seam against the adjacent underlying portion of the jacket using one edge of the seam as the folding axis. It will be appreciated that the closed seam provides a reinforcing straight edge greatly facilitating both the gathering and the folding operations and assuring that the entire procedure will be performed expeditiously and neatly, despite the fact that the foldover is wider at the lower smaller diameter of the piling that at its upper end.

Once the jacketing has been snugly gathered about the piling in the manner just described, the workmen proceed to cinch the free ends of the tie bands 32. The ends 33 of the tie bands are preferably cinched tight using a pair of identical plastic rings 41,42 which may be either circular or rectangular in configuration. The free ends 33 of the tie bands are threaded through the center of a pair of these rings while axially aligned following which the free ends of the bands are wrapped outwardly about the exterior of ring 42 and then inwardly about the interior side of ring 41 in the manner made clear in FIG. 6. This operation is performed while the tie bands are loosely gathered about the piling. Once the threading operation has been completed, the two free ends 33,33 are grasped and pulled away from one another until the tie band has been snugly tensioned about the piling. The friction forces then acting on the two rings anchor the tie bands positively cinched and against any possibility of loosening.

If the jacketed piling is to be installed in a location where it is likely to be impacted by water craft or floating objects then it is additionally protected by the assembly of a guard strip 45 comprising an elongated strip of thick, tough high impact strength plastic or the like material preferably heavily reinforced with high strength fiber, such as fiberglass in either filament or fabric form.

The resilient guard strips preferably are molded to have a radius slightly less than that of the jacketed piling. Since the guard strips are highly resilient they are readily deformed to the extent necessary for them to conform with the underlying jacketed piling as they are clamped to the piling with the lateral edges of the guard strip holding the jacket resiliently pressed against the piling by the stored deformation stresses. These stresses are held stored in the guard strip by the fasteners 46.

Figure 3:
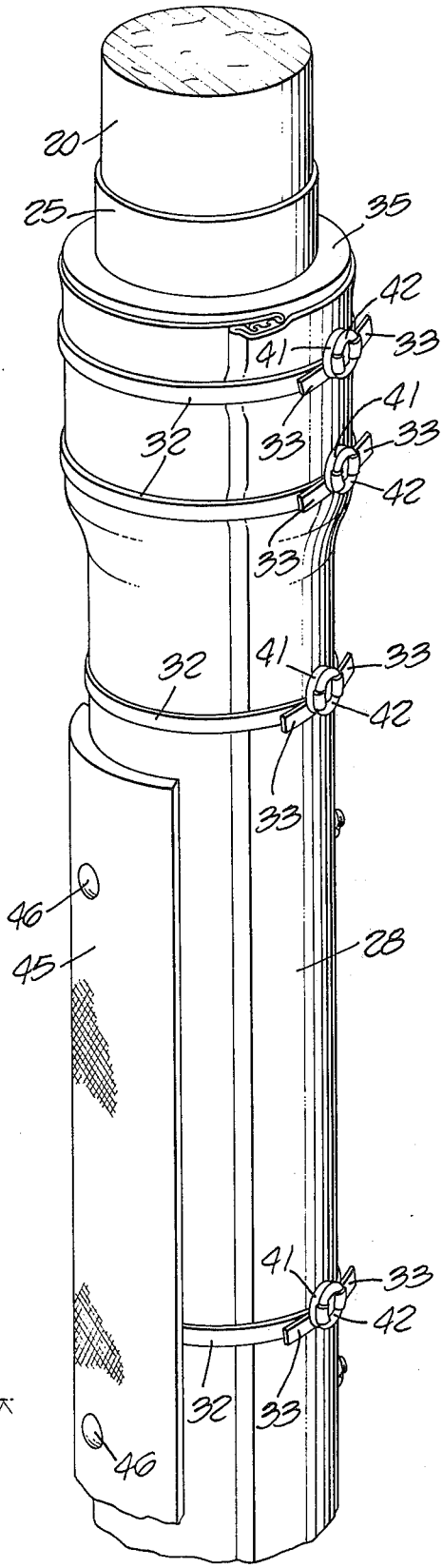
FIG. 3 is a perspective view on an enlarged scale of the upper portion of the piling shown in FIG. 2.

Securement of the guard strips to the piling is preferably by lag screws or through bolts 46, the latter being shown in use for this purpose in FIGS. 2–4. These clamping bolts are preferably arranged in axial alignment lengthwise of the strip and preferably along the center portion thereof thereby leaving the portions of the guard strips laterally of the bolts free to flex as necessary to conform with the piling.

Once the protective guards and jacketing for the piling has been assembled, piling may be transferred to a floating position in the water and then connected to the suspension cabling 18 of pile driver 12. Otherwise, the suspension cable 18 is attached to one end of the piling while in a horizontal position on the pier after which the piling is elevated to its driving position. If the jacketing is applied to the piling while suspended on the pile driver the operators may start to attach the jacketing to the upper end of the suspended piling and then proceed downwardly or they may lower the piling to a convenient operating position for application of the jacketing and then elevate it as the seam is closed and the tie bands are cinched tight.

Figure 7:
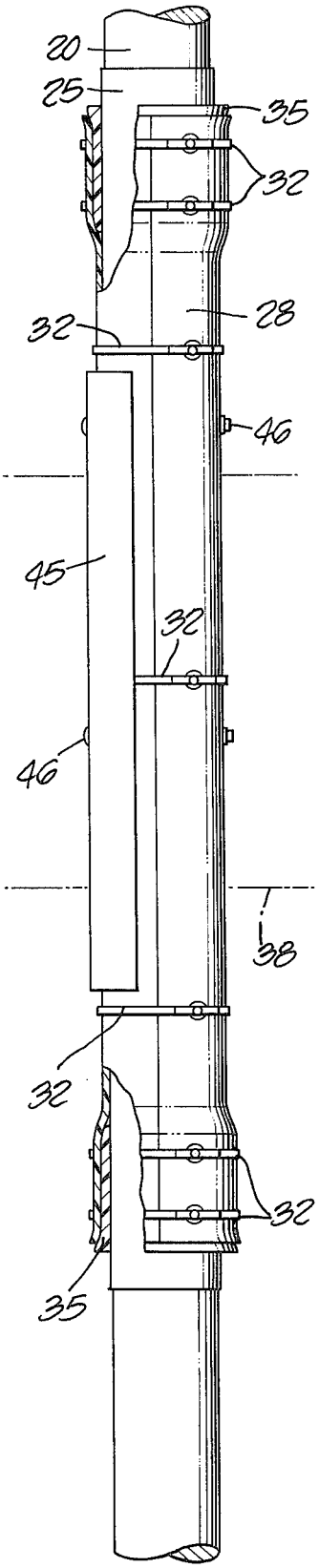
FIG. 7 is a view similar to FIG. 2 but showing the invention protective components enclosing a portion of the piling somewhat longer than the portion thereof between low and high water levels.

However the jacketing is assembled, this operation is completed under dry working conditions without need for divers or diving equipment and then driven using either floating or non-floating pile driving equipment. The driving operation is continued in the usual case until the lower end of the jacketing 28 extends beneath mudline 36 by one or two feet. Thereafter, mud or other sealing material 39 is filled in around the base of the pile. If on the other hand, marine growth is of a type such that extension of the jacket below the mudline is not necessary then the jacketing is applied as illustrated in FIG. 7 with the opposite ends of the jacketing extending well beyond the high and low water levels indicated by the dot and dash lines in FIG. 7. If the piling is located in exposed areas likely to be contacted by water craft then it is common practice to apply a wooden fender strip 48 against the exterior of guard strips 45 in the manner best shown in FIG. 2.

While the particular protective guard means for wood piling herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. That improvement in protecting piling against damage which comprises a plastic jacket assembled about the midlength of piling from a point close to the mudline to a point above the normal high water level, and an elongated guard strip arched crosswise thereof with a radius shorter than the radius of the juxtaposed length of the piling to which said guard strip is to be secured and formed of non-metallic tough high impact strength resilient sheet material, and fastener means located along the longitudinal central portion of said guard strip for holding the latter clamped under stored deformation stress with its lateral edges pressing said jacket against the piling from a point above high water level to a point below low water level and in position likely to be contacted by water craft and floating objects approaching the piling when installed in water along a coastal area.

2. That improvement in the protection of plastic jacketing embracing piling to protect the plastic jacketing from damage by impact with floating objects which comprises an elongated guard strip of non-metallic tough resilient high impact strength fibrous material impregnated with cured resinous material and arched transversely of the length thereof on a radius shorter than the radius of the juxtaposed length of the piling to which said guard strip is to be attached, and a plurality of openings confined to spaced apart points along the longitudinal central portion of said strip to receive fastener means for securing said guard strip against plastic jacketed piling on the side thereof likely to be contacted by water craft and floating objects from a point above high water level to a point below water level and the lateral edges of which guard strip are adapted and effective to hold an underlying plastic jacket resiliently pressed against the piling.

3. A protective jacket for piling comprising a continuous length of supple plastic material equipped along the lateral edges thereof with interlocking seam forming means and sufficiently long to provide separate jackets for a plurality of piling, and a plurality of flexible tie bands having the midportions thereof secured to one face of said jacket crosswise of the length of said continuous protective jacket at spaced apart intervals therealong, and a pair of cinching ring means for securing the free ends of individual ones of said tie bands positively cinched together under tension after assembly of said jacket about piling.

4. A length of piling ready for lowering into the water and driving into a water bed and equipped with a watertight plastic jacket for a major portion of its midlength, said piling including a resilient fluidtight sealing collar encircling the piling in an area to be located above high water level when the piling is installed, a one piece flexible plastic jacket equipped with interlocking plastic tongue and groove seam forming means along its lateral edges and assembled about said piling from the upper end of said collar to a point adapted to be located below the mudline of the driven piling, tie band means attached to said jacket crosswise thereof holding said jacket gathered snugly about said collar and piling at intervals along the length thereof, impact guard means secured against the exterior of said plastic jacket by fastener means located along the longitudinal central portion thereof, said guard means having its upper end positioned above the prospective high water level and its lower end positioned below the prospective low water level of the installed operating environment of the piling, said guard means being of thick tough resinous material arched crosswise of its length on a radius shorter than the radius of said piling with its lateral edges resiliently pressing contiguous portions of said jacket against said piling and effective to shield said jacket from damage by direct impact with watercraft and floating objects after the piling has been driven into a water bed.

* * * * *